US008381645B2

(12) United States Patent
Hejplik

(10) Patent No.: US 8,381,645 B2
(45) Date of Patent: Feb. 26, 2013

(54) RADIAL PRESS

(75) Inventor: Vaclav Hejplik, Plzen (CZ)
(73) Assignee: Uniflex-Hydraulik GmbH, Karben (DE)

( * ) Notice: Subject to any disclaimer, the term of this patent is extended or adjusted under 35 U.S.C. 154(b) by 0 days.

(21) Appl. No.: 13/481,277

(22) Filed: May 25, 2012

(65) Prior Publication Data

US 2012/0227596 A1 Sep. 13, 2012

Related U.S. Application Data

(63) Continuation of application No. PCT/EP2010/007473, filed on Dec. 9, 2010.

(30) Foreign Application Priority Data

Dec. 10, 2009 (DE) ..... 10 2009 057 726

(51) Int. Cl.
*B30B 7/04* (2006.01)
*B30B 15/04* (2006.01)
*B21D 41/00* (2006.01)

(52) U.S. Cl. ..... 100/269.01; 100/53; 100/269.11; 72/402; 72/453.12; 29/237; 29/282

(58) Field of Classification Search ..... 100/50, 100/214, 232, 269.01, 269.11; 72/402, 453.12; 29/237, 282
See application file for complete search history.

(56) References Cited

U.S. PATENT DOCUMENTS

| | | | | |
|---|---|---|---|---|
| 4,854,031 | A * | 8/1989 | Eisenzimmer | 29/508 |
| 5,323,697 | A | 6/1994 | Schroeck | |
| 6,257,042 | B1 * | 7/2001 | Valimaki et al. | 72/402 |
| 7,043,806 | B2 | 5/2006 | Schroeck et al. | |

FOREIGN PATENT DOCUMENTS

| | | |
|---|---|---|
| DE | 19814474 | 7/1999 |
| DE | 19817882 | 11/1999 |
| DE | 19940744 | 3/2001 |
| DE | 10047025 | 5/2002 |
| DE | 102005034260 | 7/2006 |
| EP | 0539787 | 5/1993 |
| EP | 1510269 | 1/2008 |

OTHER PUBLICATIONS

International Search Report (with English translation) for corresponding International Application No. PCT/EP2010/007473, mailed on May 27, 2011.

* cited by examiner

*Primary Examiner* — Jimmy T Nguyen
(74) *Attorney, Agent, or Firm* — Myers Wolin, LLC

(57) ABSTRACT

A radial press comprising a first and a second structure, each having a press yoke that form a receiving chamber for a press tool. Under the action of a drive unit, the second structure can be linearly moved by a pressing stroke relative to the first structure between an open position and a pressing end position in a working plane perpendicular to the press axis. In the open position of the radial press, a lateral feed opening is formed between the two press yokes. The drive unit is arranged offset with respect to the press axis only on the side facing away from the feed opening. A supporting drive, which is arranged on the side of the drive unit facing away from the press axis and can be continuously longitudinally adjusted in a defined manner within a supporting stroke, acts between the first structure and the second structure.

18 Claims, 5 Drawing Sheets

RADIAL PRESS

CROSS REFERENCE TO RELATED APPLICATIONS

Figure 1:
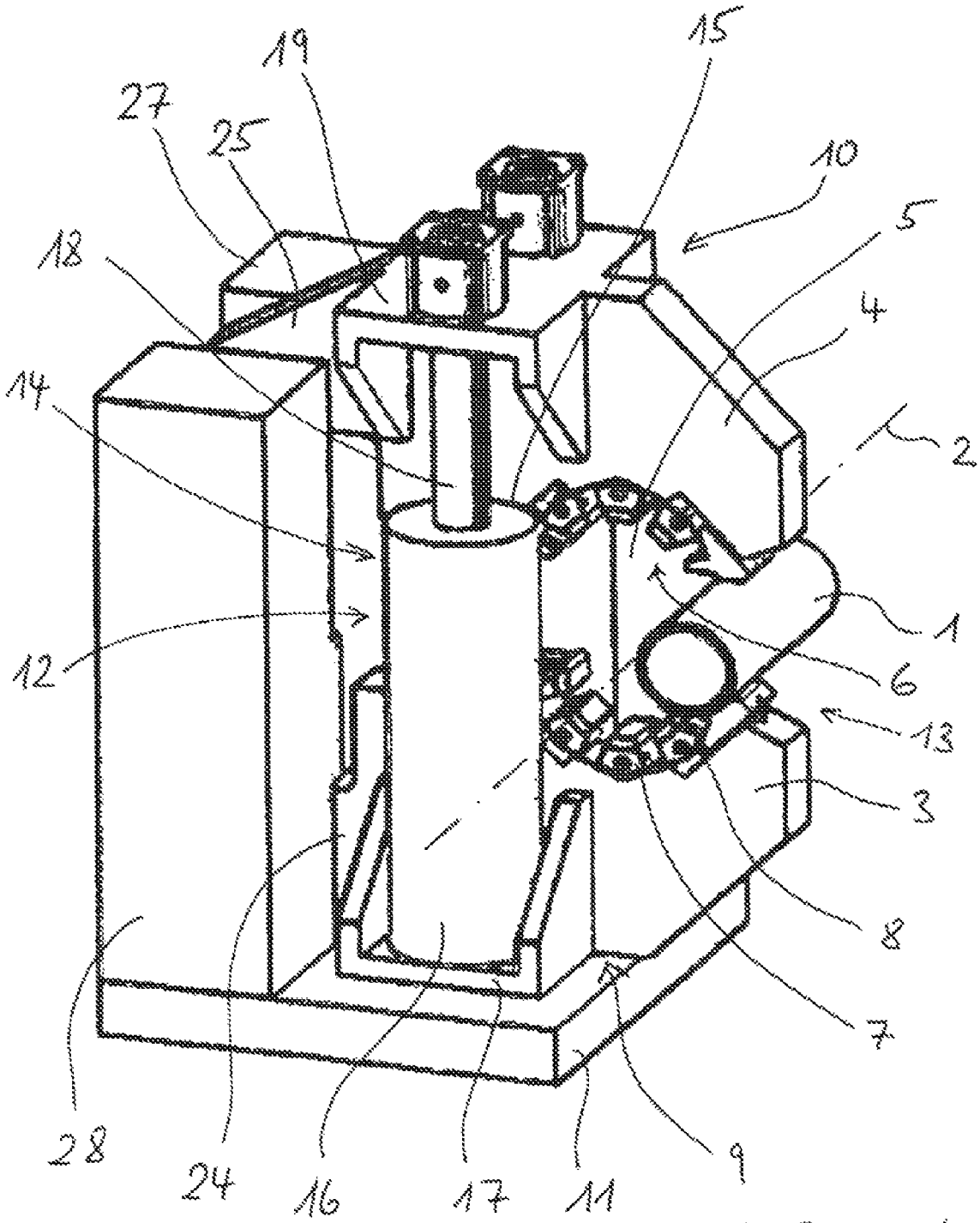

The present application is a continuation of PCT/EP2010/007473 filed on Dec. 9, 2010, which claims priority to German Patent Application No. 10 2009 057 726.2 filed on Dec. 10, 2009, the contents of each of which are incorporated herein by reference.

FIELD OF THE INVENTION

The present invention relates to a radial press for radial deformation of workpieces relative to a press axis, comprising a first structure having a first press yoke and a second structure having a second press yoke, wherein the two press yokes form a receiving chamber for a press die comprising a plurality of press jaws and, under the action of a drive unit, the second structure can be moved linearly relative to the first structure by a press stroke between an open position and a press end position in a working plane disposed perpendicular to the press axis, and also wherein, in the open position of the radial press, a lateral charging opening is formed between the two press yokes, the drive unit is disposed offset from the press axis only on the side facing away the charging opening and the press die is of split construction, so that, in the open position of the radial press, the workpiece can be fed laterally, in a direction transverse relative to the press axis, through the charging opening into the press die.

BACKGROUND

A radial press of the type indicated in the foregoing is known from EP 1510269 B1. Compared with other known radial presses, in which two press yokes movable relative to one another in a plane perpendicular to the press axis form a receiving chamber for a press die between them (see, for example, EP 539787 A1, DE 19814474 C1, DE 4135465 A1), it is characterized by the possibility of insertion of a workpiece radially through the lateral charging opening into the die when the press is open. This is an advantage of considerable practical relevance for diverse applications, as DE 19817882 B4 in particular also demonstrates.

Because of problems jeopardizing functional safety, however, it has been found in practical trials that the radial press of the class in question known from EP 1510269 B1 is not adequately suitable in practice.

SUMMARY

From this knowledge the object underlying the present invention has been derived, to the effect of providing a radial press of the class in question that is characterized by increased functional safety compared with the prior art.

This object is achieved by the fact that, in a radial press of the class in question, a support drive, which is disposed on the side of the drive unit facing away from the press axis and can be continuously varied in length to a defined extent within a support stroke, acts between the first structure and the second structure, to supply at least over one part of the press stroke an opposing force acting between the first structure and the second structure in a direction counter to the direction of action of the drive unit. A central aspect of the present invention, cooperating functionally with the further features defining the inventive radial press, consists according thereto in selectively building up, between the first and the second structures, by means of the support drive, an opposing force counter to the press force supplied by the drive unit during at least one part of the press stroke, and specifically on the side of the drive unit opposite the die. In this way the support drive ensures complete or at least partial compensation, acting internally in the press, directly between the first and the second structure, of moments that act on the two press yokes due to the lateral offset or the eccentricity of drive unit and die, so that the danger of tilting and similar influences jeopardizing the functional safety is considerably reduced. In this way the present invention departs expressly and intentionally from the previously followed approach of making the force supplied by the drive unit completely or at least very largely available for radial deformation of the workpiece and conducting it for this purpose into the workpiece. In the present case, a part of the force supplied by the drive unit is compensated at least in the load stroke (see hereinafter) by the support drive used according to the invention. In the interests of increased functional safety, however, as is achieved by the reduction of the internal eccentric forces and moments, this is intentionally tolerated, in order to improve the functional safety and thus the practical utility of the radial press within the meaning of the stated object.

By the fact that a separate support drive acting between the first and the second structure is used for the purpose outlined in the foregoing, an influence on the internal flows of forces can be exerted selectively, actively and in a manner matched to the sequences in the radial press, thus achieving the goal to an excellent degree and in turn permitting very good forming results with the highest reproducibility.

Advantageously the drive unit of the inventive radial press—within the meaning of a first preferred improvement—comprises at least one tension assembly, which supplies the press force and in particular may be constructed as a hydraulic cylinder-piston unit. Particularly preferably, the drive unit comprises two such tension assemblies, wherein the two tension assemblies are then disposed in particular on different sides of the working plane. The opposing force acting between the first and the second structures and supplied by the support drive consists in this case of a compressive force, which to some extent brakes the movement, caused by the drive unit, of the two structures toward one another. In this respect it is apparent that the active, selective braking of the movement of the two structures over at least part of the press stroke by means of the support drive, which according to the invention is disposed and acts between the two structures and can be continuously varied in length, may already be sufficient for the substantial reduction of the internal eccentric forces and moments.

It is indeed apparent from the foregoing explanations that substantially the variations of forces and moments inside the radial press are involved, and so it is not primarily decisive whether now only the first structure, only the second structure or else both structures are movable. Nevertheless, specifically in the case of the improvement of the invention outlined in the foregoing, it is entirely advantageous when the first structure is firmly joined to a machine frame, wherein, in the case of construction of the at least one drive unit as a tension assembly in the form of a hydraulic cylinder-piston unit, the cylinder of the cylinder-piston unit in question preferably acts on the first structure.

According to another preferred improvement of the invention, the support drive has exactly one support member disposed in the working plane. In typical applications this is sufficient even in the region of very high press forces and it permits achievement of the present invention with relatively low structural and apparatus complexity. Nevertheless, such a configuration is in no case compulsory; to the contrary, if necessary the support drive may certainly also comprise a plurality of support members, which can be continuously varied in length in defined manner within the support stroke and which cumulatively supply the opposing force acting at least over one part of the press stroke between the first structure and the second structure in a direction counter to the direction of action of the drive unit.

Yet another preferred improvement of the invention is characterized in that the support drive comprises at least one hydraulic cylinder-piston unit. This makes it possible in particular, with simple means, to match the force supplied by the support drive and opposing the press force of the drive unit selectively to the respective application. One possibility of particularly simple construction for supplying the braking force acting as opposing force in selectively adjustable manner consists in this case in displacing hydraulic fluid from the hydraulic cylinder-piston unit of the support drive in a manner braked via a throttle (which is adjustable if necessary). Analogously, the braking force may be supplied by comparably acting hydraulic dampers, which are adjustable if necessary.

Specifically when the drive unit also comprises a hydraulic cylinder-piston unit, by constructing the support drive in such a way that it (also) comprises at least one hydraulic cylinder-piston unit, the possibility is achieved of imposing the same hydraulic pressure on the hydraulic cylinder-piston unit of the support drive during the support stroke as that on the at least one hydraulic cylinder-piston unit of the drive unit. In this case it is possible in simple manner—by matching the active areas of the cylinder-piston units involved—to adjust a fixed ratio between the opposing force supplied by the support drive and the press force supplied by the drive unit. This may be matched to the geometric conditions of the radial press, from which it is possible to derive the ideal distribution of the press force between the portion used for deformation of the workpiece and the portion compensated by the support drive, or in other words by this supplied opposing force.

Even if neither the drive unit nor the support drive respectively comprise at least one hydraulic cylinder-piston unit, it may prove expedient under the outlined viewpoints for a fixed portion of the press force to be preset for the opposing force. Such a relationship may be resident in particular in the machine controller.

On the other hand, if an adjustable ratio of the force (braking force) opposing the press force is desired, expediently a separate controller, by means of which, for example, the throttle effect explained hereinabove is adjustable, acts in this way on the support drive. In this case a common machine controller, which in particular controls the magnitude of the opposing force supplied by the support drive as a function of the press force supplied by the drive unit and/or by other process parameters, may but does not have to act on the drive unit and the support drive.

If the drive unit comprises two tension assemblies (for example, in the form of hydraulic cylinder-piston units) disposed on both sides of the working plane in the sense already outlined hereinabove, these two tension assemblies are preferably not connected in parallel in the sense (simply) that they always supply the same tension force necessarily and under all circumstances. To the contrary, it is advantageous when the two tension assemblies can be individually activated by means of a machine controller so as to simultaneously supply different tension forces, wherein this machine controller is able to process signals supplied in particular by measuring transducers internal to the machine in connection with and for adjustment of the individual tension forces. In such a configuration of the inventive radial press, it is possible, for example, to actively counteract conical deformation of the workpiece, as may occur in conventional radial presses due to different wall thicknesses or the like of the workpiece over the axial length of the compressions.

In the interests of high efficiency of the radial press, it is favorable if the distance from the support drive to the press axis is chosen to be as large as possible within the scope of the spatial capabilities. Preferably it is at least 1.5 times, particularly at least 2 times the value of the distance of the drive unit from the press axis. Under certain prerequisites, however, especially in the case of predetermined dimensions and spatial relationships of the components relative to one another, a configuration deviating from the foregoing may also prove expedient.

According to yet another preferred improvement of the invention, it is provided that the support drive may also be actuated to open the press after the press end position has been reached. In this way, opening of the radial press by active pressurization of the drive unit in the reverse direction relative to pressing can be avoided, thus possibly contributing to acceleration of the press cycle. This can be achieved specifically in the case that the support drive is constructed simply with at least one hydraulic cylinder-piston unit. In view of the existing force demand for opening the radial press, especially when the support drive comprises several hydraulic cylinder-piston units, it may be sufficient to pressurize only one of these for opening the radial press. The combination of support drive and opening drive permits particularly compact designs with short cycle times.

Analogously, according to yet another preferred improvement of the invention, the support drive may be actuated to close the press during a first partial step of the press stroke. In the first partial step of the press stroke (no-load stroke), in which the die is initially closing and no deformation of the workpiece is yet taking place, typically the force that can be supplied by the support drive is sufficient for moving the two structures toward one another. The support drive, which supplies the opposing force directed counter to the press force in the sense described hereinabove during the second partial step of the press stroke (load stroke), in which the workpiece is deformed, is used in this case during the no-load stroke as a rapid drive for (fast) closing of the press. This capability also can be achieved with a particularly simple construction when both the drive unit and the support drive comprise at least one hydraulic cylinder-piston unit. In turn, a particularly compact highly functional radial press is obtained.

According to yet another preferred improvement of the present invention, it is provided that the die comprises intermediate yokes, which are received between the press yokes, in which the guide faces for the press jaws are formed, and which are adjustable relative to the press yokes. These intermediate yokes may be displaceable in the plane of the press yokes, especially in the respective associated press yoke. This makes it possible to shift the press axis as a function of the diameter of the die in such a way that it runs as tightly as the workpiece diameter permits against the drive unit; this is favorable for the most optimum flow of force possible within the machine. A particularly preferred configuration is characterized in that the two intermediate yokes are mounted to swivel in the respective associated press yoke around an axis perpendicular to the press axis, so that the die can be turned in the press yokes. This is particularly favorable, especially in dies with a considerable extent in the direction of the press axis. Thus, if the die is turned such that the press axis is oriented parallel to the plane of the press yoke, any arrangement of the workpiece such that it is not at the center of the die but instead can become offset somewhat—in axial direction—can be actively compensated by corrective activation of the support drive in such a way that conical deformation of the workpiece is prevented. In this respect, this improvement of the invention offers a usable solution to the problem, which is relevant in practice, of development of conical compressions when workpieces are disposed outside the center of the press die.

As regards great flexibility in the use of the inventive radial press, it is particularly advantageous when the die comprising the press yokes and the press jaws is mounted in the two press yokes in such a way that it can both be displaced—in the plane of the press yokes—and swiveled around an axis perpendicular to the press axis. Regardless of the positioning capability of the die relative to the press yokes as explained in the foregoing, it also proves favorable, if dies have to be exchanged for the purpose of performing different press tasks, for the die to have intermediate yokes, which are received between the press yokes and in which the guide faces for the press jaws are formed.

BRIEF DESCRIPTIONS OF THE FIGURES

Figure 2:
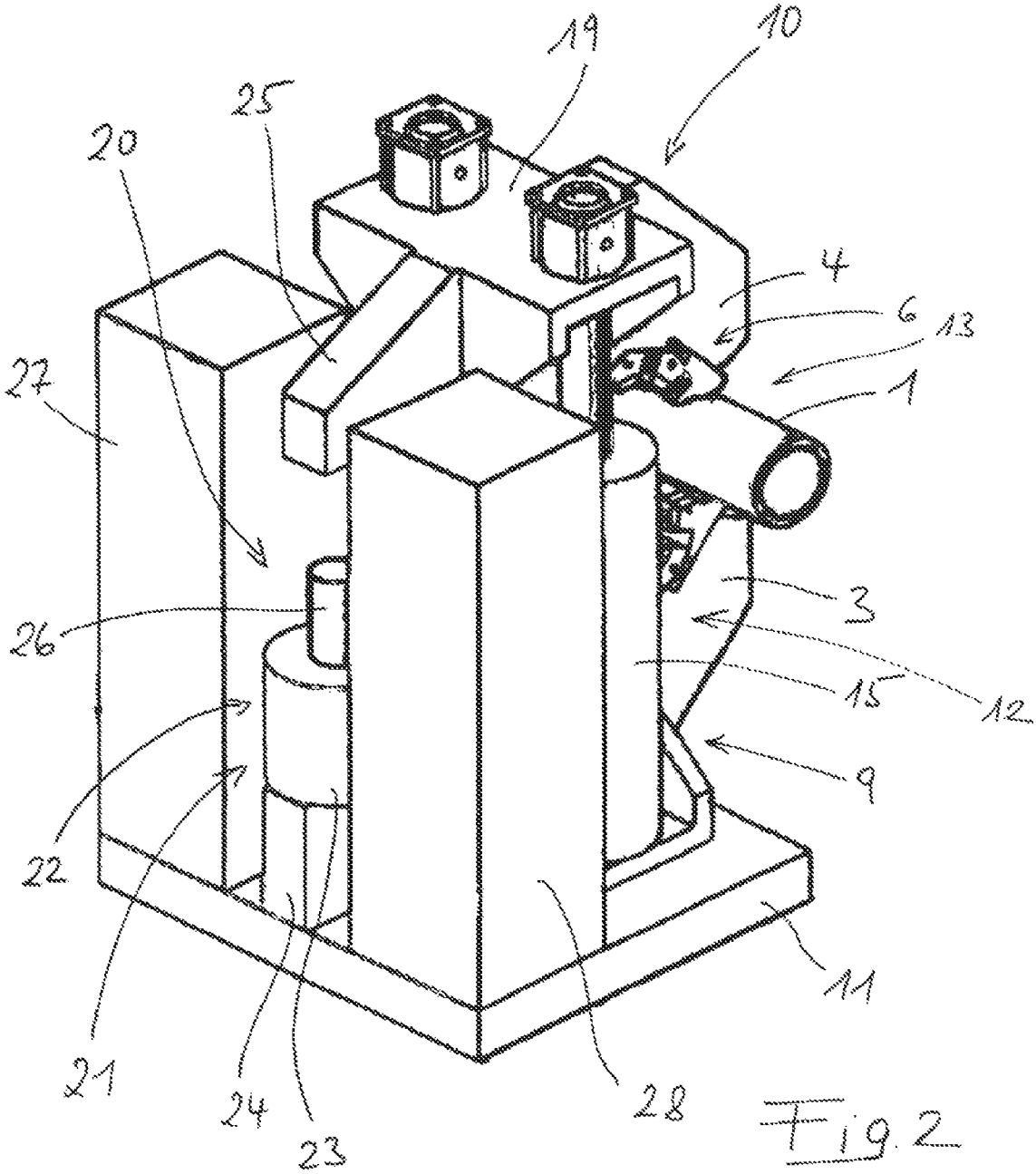
Figure 3:
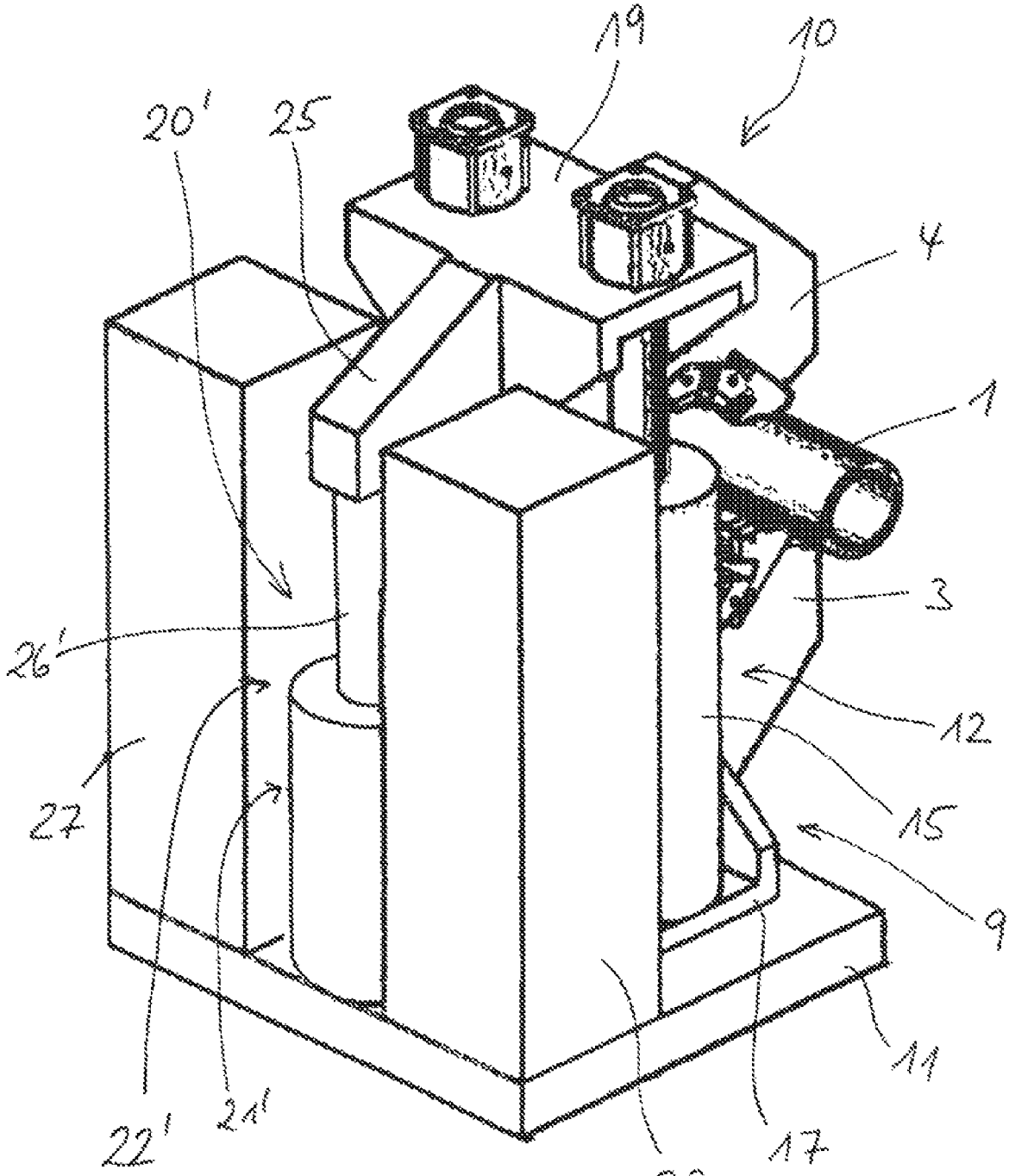
Figure 4:
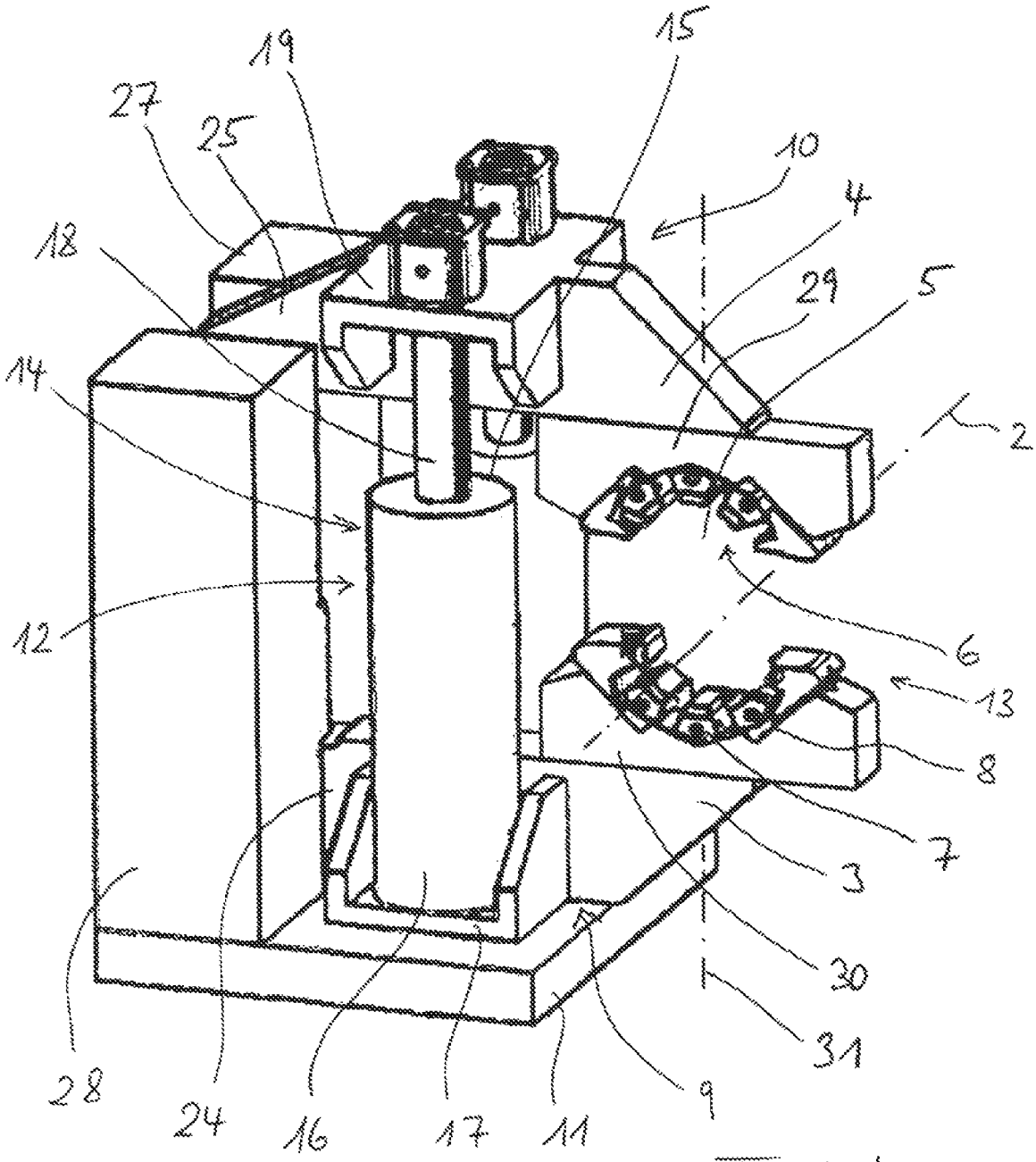
Figure 5:
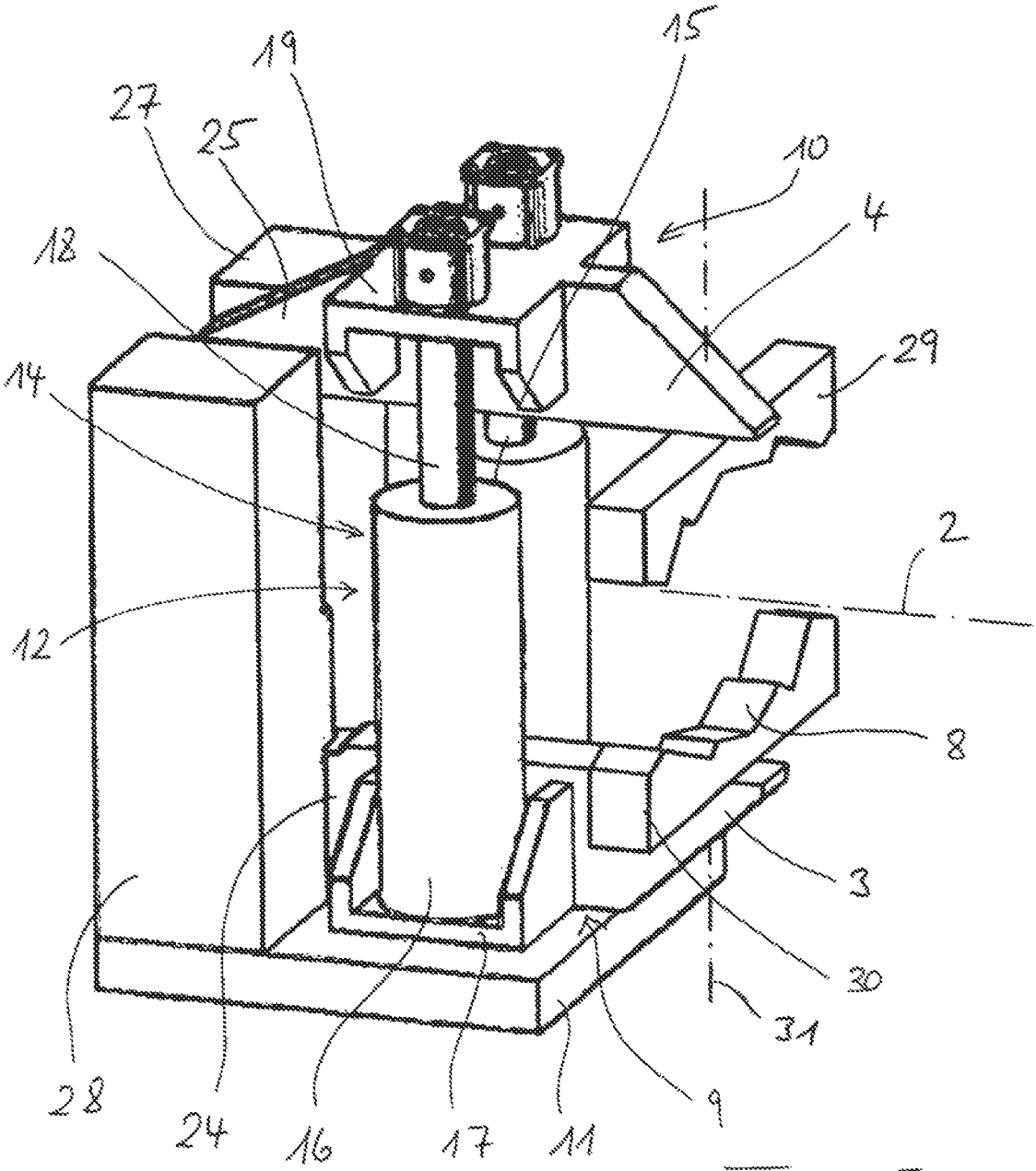

The present invention will be explained in more detail hereinafter on the basis of three preferred exemplary embodiments illustrated in the drawing, wherein FIG. 1 shows a perspective view of an exemplary embodiment of a radial press according to the present invention, FIG. 2 shows another perspective view of the radial press according to FIG. 1, FIG. 3 shows a modified embodiment of the radial press according to FIGS. 1 and 2, FIG. 4 shows another modified embodiment of the radial press according to FIGS. 1 and 2 in a first operating condition, and FIG. 5 shows the embodiment according to FIG. 4 in a second operating condition.

DETAILED DESCRIPTION

The radial press, illustrated in FIGS. 1 and 2, for radial deformation of workpieces 1 relative to a press axis 2 comprises a first press yoke 3 and a second press yoke 4. The two press yokes 3 and 4 form a receiving chamber 5 for a press die 6, which comprises a plurality of press jaws 7, which are guided slidingly in a manner known as such on associated guide faces 8. In view of the fact that adequately known prior art is involved in this respect, further explanations are unnecessary.

First press yoke 3 is a functional part of a first structure 9; and second press yoke 4 is a functional part of a second structure 10. First structure 9 is joined firmly to a machine frame 11. In contrast, second structure 10, under the action of a drive unit 12, can be moved linearly relative to first structure 9 in a working plane perpendicular to press axis 2, and specifically by a press stroke between an (upper) open position, as illustrated in the drawing, and a (lower) press end position, as well as in the reverse direction. In open position of the radial press, a lateral charging opening 13 is formed between the two press yokes 3 and 4. Furthermore, press die 6 is of split construction, so that, in open position of the radial press, workpiece 1 can be fed laterally, in the direction transverse (radial) relative to press axis 2, through charging opening 13 into press die 6.

On the side facing away from charging opening 13, drive unit 12 is disposed offset relative to press axis 2. It comprises two hydraulic cylinder-piston units 14, disposed on both sides of the working plane, acting as tension assemblies and having the form of hydraulic cylinders 15 aligned parallel to the working plane. Each of these cylinders 16 acts on a lower crosspiece 17, which forms a functional part of first structure 9, and piston rod 18 acts on an upper crosspiece 19, which forms a functional part of second structure 10. The two hydraulic cylinders simultaneously have the function of guiding the two structures 9 and 10 linearly relative to one another.

On the side of drive unit 12 facing away from press axis 2 there is disposed a support drive 20 acting between first structure 9 and second structure 10 (FIG. 2). This comprises a support member 21 disposed in the working plane and having the form of a hydraulic cylinder-piston unit 22, whose cylinder 23 is mounted on a bearing block 24, which forms a functional part of first structure 9. In contrast, second structure 10 comprises a horn-shaped stop 25. When upper second structure 10 together with second press yoke 4 is lowered from open position in the direction of the press end position by appropriate pressurization of hydraulic cylinder 15, this stop bears, at the end of the no-load stroke functioning (merely) for closing press die 6, on piston rod 26 of hydraulic cylinder-piston unit 22. During the ensuing second step of the press stroke, or in other words the load stroke, support drive 20 supplies an opposing force, which acts between first structure 9 and second structure 10 and is directed counter to the direction of action of drive unit 12. For this purpose, support drive 20 can be continuously varied in length in defined manner within a support stroke, which corresponds to the load stroke, while supplying the said opposing force. In the sense of supplying an opposing force directed counter to the drive force via the load and support stroke, support drive 20 represents a drive, in the form of a compression assembly, running counter to drive unit 12. This opposing force is supplied by well-defined throttled displacement of hydraulic fluid from hydraulic cylinder-piston unit 22 of support drive 20 during the support stroke.

As schematically illustrated in FIGS. 1 and 2, the electrical components (including the machine controller) and the hydraulic components (including the hydraulic assembly) of the radial press can be disposed on both sides of the support drive, where they are mounted protectively in appropriate housings 27 and 28.

The modified embodiment of the radial press illustrated in FIG. 3 differs from that according to FIGS. 1 and 2 solely by a different type of construction of the support drive. And specifically here, a hydraulic cylinder-piston unit 22' with a larger working stroke is used as support member 21' of support drive 20'. In particular, the working stroke of support drive 22' corresponds to that of drive unit 12, so that piston rod 26' of hydraulic cylinder-piston unit 22' is constantly associated with horn-shaped stop 25, or in other words is linked thereto. This ensures that support drive 22' can be used not only to supply the opposing force directed counter to the press force of drive unit 12 during the support stroke, but instead also to close the radial press during a first partial step (no-load stroke) of the press stroke as well as to open the radial press after the press end position has been reached. Since, as regards its main function, namely supplying the opposing force in a magnitude sufficient to compensate for internal bending moments, hydraulic cylinder-piston unit 22' of support drive 20' may typically have a considerably smaller piston cross section than the cumulative piston cross-sectional areas of hydraulic cylinder 15 of drive unit 12, it is possible, by pressurizing support drive 20' for closing the radial press during the no-load stroke as well as for opening the radial press, to achieve, compared with the use of hydraulic cylinders 15 for these movements, acceleration of the corresponding movements in the sense of rapid motion.

Merely to avoid misunderstandings, it must be pointed out that FIGS. 1 to 3 respectively show workpiece 1 not in the position completely inserted into press die 6, where it would be coaxial with the press axis, but instead in a position during radial insertion into the die through lateral charging opening 13.

The modified embodiment illustrated in FIGS. 4 and 5 differs from that according to FIGS. 1 and 2 by the fact that in this case the die, which is received between the two press yokes 3 and 4 of the radial press, comprises intermediate yokes on the die side, namely an upper intermediate yoke 29 and a lower intermediate yoke 30. In the two intermediate yokes 29 and 30 there are formed, in a manner known as such, guide faces 8, on which press jaws 7, which for reasons of simplification of illustration are not shown in FIG. 5, are guided slidingly.

The two intermediate yokes 29 and 30 are mounted to swivel around vertical axis 31 in the respective associated press yoke 3 and 4. In this way, the die comprising intermediate yokes 29 and 30 as well as the press jaws received therein can be turned in press yokes 3 and 4, or in other words relative to the machine, and specifically are configured especially in such a way that press axis 2 can assume an orientation parallel to the plane of press yokes 3 and 4 (FIG. 5) instead of an orientation perpendicular to the plan of press yokes 3 and 4 (FIG. 4).

Otherwise the embodiment according to FIGS. 4 and 5 corresponds to the embodiment according to FIGS. 1 and 2, and so, to avoid repetitions, reference is made to the foregoing explanations of that embodiment.

I claim:

1. A radial press for radial deformation of workpieces (1) relative to a press axis (2), comprising:

a first structure (9) having a first press yoke (3) and a second structure (10) having a second press yoke (4), wherein the two press yokes form a receiving chamber (5) for a press die (6) comprising a plurality of press jaws (7) and, under the action of a drive unit (12), the second structure can be moved linearly relative to the first structure by a press stroke between an open position and a press end position in a working plane disposed perpendicular to the press axis, and also wherein, in the open position of the radial press, a lateral charging opening (13) is formed between the two press yokes, the drive unit is disposed offset from the press axis only on the side facing away the charging opening and the press die is of split construction, so that, in the open position of the radial press, the workpiece can be fed laterally, in a direction transverse relative to the press axis, through the charging opening into the press die, wherein a support drive (20, 20'), which is disposed on the side of the drive unit (12) facing away from the press axis (2) and can be continuously varied in length to a defined extent within a support stroke, acts between the first structure (9) and the second structure (10), to supply at least over one part of the press stroke an opposing force acting between the first structure and the second structure in a direction counter to the direction of action of the drive unit.

2. A radial press according to claim 1, wherein the drive unit (12) comprises at least one tension assembly.

3. A radial press according to claim 2, wherein the drive unit (12) comprises two tension assemblies disposed on different sides of the working plane.

4. A radial press according to claim 3, wherein the two tension assemblies can be individually activated by means of a machine controller so as to simultaneously supply different tension forces.

5. A radial press according to claim 2, wherein the at least one tension assembly is constructed as a hydraulic cylinder-piston unit (14) and the first structure (9) is firmly joined to a machine frame (11), wherein the cylinder (15) of the at least one cylinder-piston unit (14) acts on the first structure.

6. A radial press according to claim 1, wherein the support drive (20, 20') has exactly one support member (21, 21') disposed in the working plane.

7. A radial press according to claim 1, wherein the support drive (20, 20') comprises at least one hydraulic cylinder-piston unit (22, 22').

8. A radial press according to claim 7, wherein the opposing force is supplied by displacement, in well-defined throttled manner, of hydraulic fluid from the at least one hydraulic cylinder-piston unit (22, 22') of the support drive (20, 20').

9. A radial press according to claim 7, wherein the drive unit (12) comprises at least one hydraulic cylinder-piston unit (14) and the at least one hydraulic cylinder-piston unit (22, 22') of the support drive (20, 20') is pressurized during the support stroke with the same hydraulic pressure as the at least one hydraulic cylinder-piston unit of the drive unit.

10. A radial press according to claim 1, wherein a common machine controller, which controls the magnitude of the opposing force supplied by the support drive as a function of the press force supplied by the drive unit, acts on the drive unit (12) and the support drive (20, 20').

11. A radial press according to claim 10, wherein a fixed portion of the press force is preset in the machine controller for the opposing force.

12. A radial press according to claim 1, wherein the distance from the at least one support drive (20, 20') to the press axis (2) is at least 1.5 times the value of the distance of the drive unit (12) from the press axis.

13. A radial press according to claim 1, wherein the support drive (20') may be actuated to open the radial press after the press end position has been reached.

14. A radial press according to claim 1, wherein the support drive (20') may be actuated to close the radial press during a first partial step of the press stroke.

15. A radial press according to claim 1, wherein the die comprises intermediate yokes (29, 30), which are received between the press yokes (3, 4) and in which the guide faces (8) for the press jaws (7) are formed.

16. A radial press according to claim 15, wherein the intermediate yokes (29, 30) are adjustable relative to the press yokes (3, 4).

17. A radial press according to claim 16, wherein the intermediate yokes (29, 30) in the respective associated press yoke (3, 4) are displaceable in the plane of the press yokes.

18. A radial press according to claim 16, wherein the intermediate yokes (29, 30) are mounted to swivel in the respective associated press yoke (3, 4) around an axis (31) perpendicular to the press axis (2).

* * * * *